United States Patent [19]

Talbert

[11] Patent Number: 4,955,332

[45] Date of Patent: Sep. 11, 1990

[54] METHOD OF IMPROVING FUEL COMBUSTION EFFICIENCY

[75] Inventor: William L. Talbert, York, Pa.

[73] Assignee: Talbert Fuel Systems, Inc., Allentown, Pa.

[21] Appl. No.: 347,753

[22] Filed: May 5, 1989

Related U.S. Application Data

[60] Division of Ser. No. 236,162, Aug. 25, 1988, Continuation-in-part of Ser. No. 941,833, Dec. 15, 1986, abandoned, which is a continuation of Ser. No. 833,038, Feb. 26, 1986, abandoned, which is a continuation of Ser. No. 638,069, Aug. 6, 1984, abandoned, which is a continuation of Ser. No. 463,251, Feb. 2, 1983, abandoned, which is a continuation of Ser. No. 70,683, Aug. 29, 1979, abandoned.

[51] Int. Cl.[5] ..... F02B 75/12

[52] U.S. Cl. ..... 123/1 A; 44/50; 123/557

[58] Field of Search ..... 123/1 A, 25 D, 557; 208/16; 585/14; 44/50

[56] References Cited

U.S. PATENT DOCUMENTS

| | | | |
|---|---|---|---|
| 1,239,099 | 9/1917 | Hall | 44/50 |
| 1,239,100 | 9/1917 | Hall | 44/50 |
| 1,409,404 | 3/1922 | Ramage | 44/51 |
| 1,429,175 | 9/1922 | Thompson | 48/127.3 |
| 1,523,314 | 1/1925 | Thompson | 44/52 |
| 2,032,330 | 2/1936 | Roberts et al. | 208/16 |
| 2,055,455 | 9/1936 | Taylor et al. | 208/17 |
| 2,076,519 | 4/1937 | Smith | 208/16 |
| 2,190,480 | 2/1940 | Nichols, Jr. et al. | 208/17 |
| 2,204,215 | 6/1940 | Greensfelder et al. | 208/17 |
| 2,407,716 | 9/1946 | Marschner | 123/1 A |
| 2,409,157 | 10/1946 | Schulze et al. | 123/1 A |
| 2,888,394 | 5/1959 | Christensen et al. | 208/16 |
| 2,894,896 | 7/1959 | Housam et al. | 208/17 |
| 2,968,609 | 1/1961 | Lutz | 208/16 |
| 3,002,917 | 10/1961 | Hamilton | 208/17 |
| 3,009,789 | 12/1959 | Jordan et al. | 44/52 |
| 4,050,419 | 9/1977 | Harpman et al. | 123/25 D |
| 4,112,889 | 9/1978 | Harpman | 123/25 B |
| 4,180,036 | 12/1979 | Wolf | 123/25 B |
| 4,429,675 | 2/1984 | Talbert | 123/558 |

FOREIGN PATENT DOCUMENTS

| | | |
|---|---|---|
| 245268 | 6/1963 | Australia . |
| 598895 | 3/1948 | United Kingdom . |

OTHER PUBLICATIONS

Petroleum Products Handbook, Guthrie, 1960 1st Ed., 4–51–4–53.

*Primary Examiner*—E. Rollins Cross
*Attorney, Agent, or Firm*—Bacon & Thomas

[57] ABSTRACT

A liquid hydrocarbon gasoline is provided by removing both the volatile and non-volatile components from $C_4$–$C_{12}$ gasoline to yield either a $C_6$–$C_9$ or a $C_6$–$C_{10}$ intermediate gasoline. The intermediate gasoline of this invention can be combusted in a standard carbureted engine with less $C_4$ and/or $C_5$ priming than in required in standard $C_4$–$C_{12}$ gasoline, and thus provides adequate cold engine starting ability with lower Reid Vapor Pressure. The $C_6$–$C_9$ and $C_6$–$C_{10}$ fuel can be combusted in a modified engine without any priming by gasifying the fuel. The fuel is gasified by heating it in a chamber in the absence of air; mixing the gas with air and then combusting the mixture. The gasified fuel is advantageous because it doesn't condense into droplets and thereby is combusted more completely in the gaseous state enhancing combustion efficiency. The fuels of this invention better facilitate alcohol addition than current gasolines because of their lower Reid Vapor Pressures.

12 Claims, 1 Drawing Sheet

METHOD OF IMPROVING FUEL COMBUSTION EFFICIENCY

CROSS REFERENCES TO RELATED APPLICATIONS

The present invention is a division of Ser. No. 236,162 filed Aug. 25, 1988, presently pending; which is a continuation-in-part of Ser. No. 941,833 filed Dec. 15, 1986, presently abandoned which is a continuation of Ser. No. 833,038 filed Feb. 26, 1986, presently abandoned; which is a continuation of Ser. No. 638,069 filed Aug. 6, 1984, presently abandoned; which in turn is a continuation of Ser. No. 463,251 filed Feb. 2, 1983, presently abandoned which in turn is a continuation of application Ser. No. 070,683 filed Aug. 29, 1979 which is presently abandoned.

BACKGROUND OF THE INVENTION

1. Field of the Invention

This invention relates to new automotive gasolines having intermediate carbon ranges, and their improved use in internal combustion engines. In particular the invention relates to new gasoline for use in improved gasified carburetion systems.

2. Background Information

Present day automotive gasoline consists of a mixture of hydrocarbons which range from $C_4$ to about $C_{12}$. The lower molecular weight fraction, such as butane isomers, is more volatile and it has always been the practice to include substantial portions of these volatiles in the fuel to insure proper engine performance. This practice, however, is at best a compromise since the presence of the volatiles, on the one hand, causes an undue risk of explosion during storage and handling; and the inherent evaporative and emission losses contribute to pollution; but, on the other hand, the volatiles have always been considered necessary for good cold engine starting. Thus, a certain amount of the volatiles have been incorporated in gasoline. The exact amount of the volatiles may vary according to the climate where it is sold. In fact, industry has set voluntary limits so that each area will have a motor fuel having sufficient volatility for the prevailing climate. High levels of volatile components assure satisfactory starting and warm-up at the lowest temperature expected, and low levels of volatile components protect against vapor-lock in high temperature climates.

Generally current gasolines exhibit high levels of volatiles measured in terms of Reid Vapor Pressure. Reid Vapor Pressure is the accepted measurement of gasoline volatility and it represents the vapor pressure at 100° F. Current fuels require a relatively high amount of volatile components which raises the Reid Vapor Pressure to undesirable levels. It is highly desirable to formulate a fuel which satisfies the volatility requirements without raising the Reid Vapor Pressure to the undesirable level found in the prior art fuels.

The use of these volatiles in prior art fuels is associated with several problems. One such problem is that because present day engines depend on the volatiles, the spontaneous loss of them in storage results in a the fuel which is of inferior quality after a period of storage. Thus, because of varying storage times, the consumer can never be certain if the gas he is purchasing contains the required amount of volatiles at the time of purchase. Naturally, therefore, a fuel whose efficiency and dependability is less dependent on the presence of volatiles is more desirable.

Another problem arising out of the use of these volatiles is the evaporative loss of gasoline which can occur in the gas tank. Industry has been hard pressed to solve this problem for quite some time. While this problem has been recognized for some time, industry has always been reluctant to solve the problem by reducing the volatility of the gasoline because in doing so they would lose the benefits of the compromise (i.e., engine performance). In fact, this point has been expressed in the publication titled *Effects of Automotive Emission Requirements on Gasoline Requirements*; Symposium, American Society for Testing and Materials; 1971. Here it is stated on page 111 that "Severe volatility reduction could produce other problems. A more effective method than volatility reduction can be seen to be the elimination of evaporative losses by some mechanical device". This invention, however, seeks to reduce volatility or Reid Vapor Pressure and still maintain a fuel which can perform well.

Present day gasoline also contains, in addition to the volatile light-weight and the intermediate-weight components, a heavy-weight component which, like the volatile component, is also associated with several disadvantages. For example, the gasoline of today, when used as a fuel in present day short stroke engines, results in incomplete combustion because there is insufficient time or temperature to burn the heavy hydrocarbon components. This results in a certain amount of gasoline being wasted and this contributes to pollution. Conventional $C_4$–$C_{12}$ has too much energy in it for conventional internal combustion engines in that if combusted with enough air (stoichiometric or slightly above) it will burn too hot for the engine or it will produce high levels of nitrous oxides. Yet, in spite of these shortcomings, the heavy components are left in present day fuel because their presence is considered necessary to provide a fuel having suitable properties for automotive use.

The presence of these heavy components in conventional $C_4$–$C_{12}$ gasoline requires considerable front end priming with light components ($C_4$ and/or $C_5$) to achieve adequate front end volatility for starting engines equipped with standard carburetion systems. In addition, conventional $C_4$–$C_{12}$ gasoline which contains these heavy components ($C_{11}$ and $C_{12}$) cannot be easily gasified and maintained in the gaseous state without recondensing. Consequently, conventional $C_4$–$C_{12}$ gasoline has limited utility in a more efficient carburetion system of the type which requires gasification in the absence of air before mixing the gasified fuel with air for combustion. Therefore, in view of the shortcomings associated with the heavy weight hydrocarbons, especially $C_{11}$ and $C_{12}$, it would be highly desirable to formulate the gasoline without these heavy components being present while also avoiding the problems associated with the absence of these components.

The use of conventional $C_4$–$C_{12}$ fuels in standard carbureted internal combustion engines requires that the volatility of the fuel be adjusted to achieve a Reid Vapor Pressure of at least 9 in the summer and 12 in the winter. If the Reid Vapor Pressure of conventional $C_4$–$C_{12}$ gasoline falls below the above limits, starting and running the engine is severely impaired. The fuels of the present invention will easily start and operate identical engines yet these fuels have a reduced Reid Vapor Pressure in comparison to the above-mention conventional $C_4$–$C_{12}$ gasoline. Thus the summer fuels of the present invention may have a Reid Vapor Pressure less than 9 and the winter fuels may have a Reid Vapor Pressure of less than 12. In particular, it is been discovered that the fuel of the present invention having a Reid Vapor Pressure as low as 6 in the summer and 9 in the winter will easily start and operate identical engines which require conventional fuels having a Reid Vapor Pressure of 9 in the summer and 12 in the winter. The Reid Vapor Pressures can be reduced even further by using the fuels of the present invention in combination with the improved carburetion system of the present invention.

SUMMARY OF THE INVENTION

It is an object of this invention to provide gasolines for automotive engines which minimize the requirement for volatile components in the fuel without sacrificing adequate engine performance and which lowers the Reid Vapor Pressure while maintaining good front end volatility.

It is also an object of this invention to provide a gasoline having a low Reid Vapor Pressure which combusts more efficiently than conventional gasoline of the type having a hydrocarbon range of $C_4$–$C_{12}$.

It is another object of this invention to provide a gasoline which has greater tolerance for alcohol enrichment because of low Reid Vapor Pressure.

It is yet another object of this invention to provide a gasoline which minimizes the priming needed to achieve adequate front end volatility for starting engines equipped with standard carburetion systems.

It is a further object of this invention to provide an improved gasoline which has enhanced gasification characteristics in improved carburetion systems.

It is another object of this invention to provide an improved process for more completely combusting the fuel of this invention in an engine thus negating the need for fuel injection systems or catalytic converters.

These and other objects of the invention will become apparent to those skilled in the art from the following disclosure of the invention.

The objects of the present invention are achieved by the discovery that front-end priming of gasoline is not necessary in gasifier type carburetors and that the heavier components in gasoline are not stable as gases in air using gasifier type carburetors. Therefore it was possible to develop new intermediate hydrocarbon range gasolines that have unique benefits not obtained in C4–C12 gasoline. In addition the new gasification methods have distinct advantages over the prior art.

One aspect of the invention relates to a gasoline having an intermediate hydrocarbon range relative to conventional $C_4$–$C_{12}$ gasoline which contains $C_4$, $C_5$, $C_6$, $C_7$, $C_8$, $C_{10}$, $C_{11}$ and $C_{12}$ hydrocarbons. The intermediate range gasoline is made by removing the lighter volatile component as well as the heavier component from a conventional gasoline starting material. The resulting fuel is $C_6$–$C_{10}$; i.e. the hydrocarbons are limited to those in the range $C_6$–$C_{10}$. Also, in accordance with this aspect of the invention, it may be desirable to further remove the $C_{10}$ component to form a $C_6$–$C_9$ gasoline for improved winter performance in gasifier type carburetors.

Suitable starting material to produce the gasoline of this invention is conventional gasoline having a range of $C_4$–$C_{12}$ Both the heavy and light components are removed by any of the known methods currently available such as heat fractionization or the use of heat and vacuum in the absence of air. Once removed, the heavy component may be "cracked" at the refinery to make more gasoline and the volatile component, most of which is being wasted today, may be fully recovered at the refinery.

Although gasoline having a range of $C_4$–$C_{12}$ is mentioned as a useful starting material, it is not critical that the starting material be precisely in this range. Rather, it is the essence of this invention to produce a gasoline fraction of intermediate carbon range relative to the given range $C_4$–$C_{12}$ that may be produced directly from refinery hydrocarbon streams.

It will be apparent, of course, that the $C_6$–$C_{10}$ and $C_6$–$C_9$ fuels of the invention cannot be used efficiently in conventional internal combustion engines without modification of the carburetion system. It has been found, however, that the gasoline of this invention can be quickly volatilized in a heated chamber by heating to a temperature above final boiling point of the fuel at one atmosphere pressure in the absence of air, and such apparatus can be readily installed in an automobile. The resulting vapor (produced as needed) will mix readily with air to form a homogenous mixture without formation of condensed droplets; will not be subject to liquid phase oxidation prior to ignition; and will ignite well in the gaseous form.

Since not all the $C_6$–$C_{10}$ and $C_6$–$C_9$ gasoline can be used efficiently in a conventional internal combustion engine without modification of the carburetion system, the present invention also provides an improved fuel for use in cars having standard carburetion systems. In connection with this, it has been discovered that the above described $C_6$–$C_{10}$ and $C_6$–$C_9$ gasoline can be used in an internal combustion engine having a standard carburetion system by priming the gasoline with a minimum amount of $C_4$, $C_5$ or a mixture of $C_4$ and $C_5$ to produce a gasoline having adequate front end volatility for starting cars equipped with standard carburetion systems. Since the gasoline may be primed with $C_4$ and/or $C_5$, then the permissible range of such a fuel will be $C_4$–$C_9$ (winter) and $C_4$–$C_{10}$ (summer) In particular, it has been discovered that the amount of $C_4$ or $C_5$ priming necessary for achieving adequate front end volatility for starting engines equipped with a standard carburetion system is less than the amount required with conventional $C_4$–$C_{12}$ gasoline. Thus, this aspect of the invention provides an improved fuel for standard carbureted engines and this fuel will advantageously contain less $C_4$ or $C_5$ than conventional $C_4$–$C_{12}$ gasoline while maintaining adequate front end volatility and reduced Reid Vapor Pressures. In other words, the $C_6$–$C_{10}$ and $C_6$–$C_9$ gasoline requires less priming to achieve adequate front end volatility for starting engines equipped with standard carburetion systems than does normal $C_4$–$C_{12}$ automotive gasoline. This represents a unique and unexpected method of achieving lower Reid Vapor Pressure in automotive gasoline while maintaining adequate-front end volatility since one would assume that lighter gasoline ($C_4$–$C_9$and $C_4$–$C_{10}$) would have higher Reid Vapor Pressure than heavier $C_4$–$C_{12}$ gasoline.

The amount of $C_4$, $C_5$ or mixture of $C_4$ and $C_5$ used to prime the $C_6$–$C_{10}$ or $C_6$–$C_9$ gasoline is a minimum amount necessary to achieve adequate front end volatility for starting a car equipped with a standard carburetor.

The $C_4$–$C_{10}$ and $C_4$–$C_9$ gasoline can also be made by removing the heavy and light components from gasoline as described above for making $C_6$–$C_{10}$ and $C_6$–$C_9$ with the exception that an adequate amount of $C_4$ and/or $C_5$ is retained in the product to achieve adequate front end volatility for starting a car equipped with a standard carburetor.

It has also been discovered that adequate front end volatility for engines equipped with standard carburetion can be achieved by priming with additional $C_5$ so that adequate front end volatility can be achieved without any $C_4$ priming.

BRIEF DESCRIPTION OF THE DRAWINGS

FIG. 1 also illustrates the fuel efficiency of the gasoline of this invention combusted in an identical engine equipped with the improved carburetor of this invention.

DETAILED DESCRIPTION OF THE INVENTION AND PREFERRED EMBODIMENTS

Figure 1:
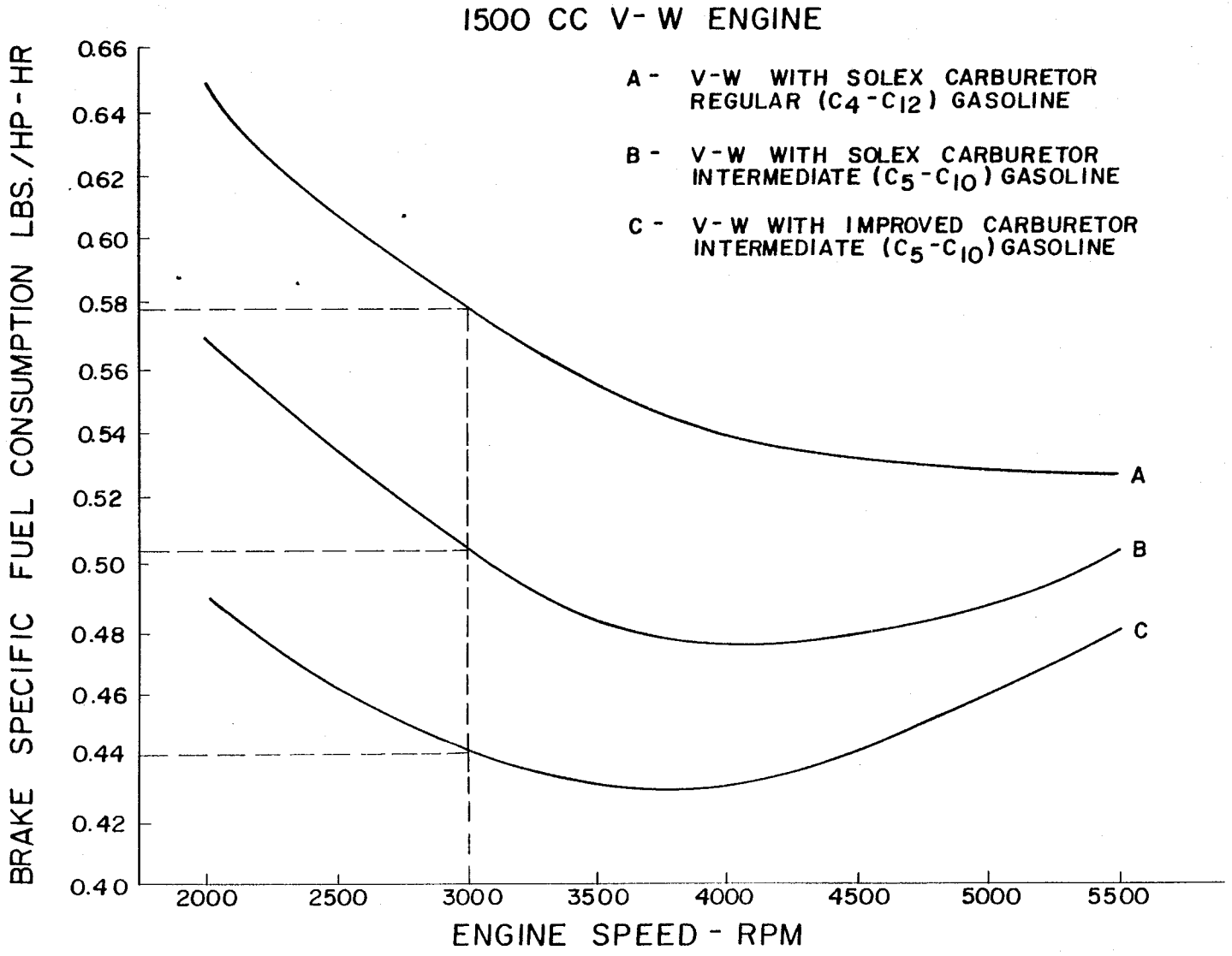
FIG. 1 is a graph which illustrates the fuel efficiency of selected fuels in a 1500 c.c. Volkswagon engine at various engine speeds. The vertical axis shows the efficiency in term of lbs. of fuel/horsepower hour. The horizontal axis measures the engine speed.

In the manufacture of a gasoline in accordance with a preferred embodiment of the present invention, both the lighter volatile component and the heavier, slow-burning component are removed from gasoline in the $C_4$–$C_{12}$ range. The removal of the volatile component makes the resultant fuel have a slower rate of burning. By also removing the heavy slow-burning component, the resultant fuel is an intermediate gasoline having a burn rate comparable to or better than the starting stock gasoline ($C_4$–$C_{12}$) from which it was made.

The most abundant of the volatile components in conventional $C_4$–$C_{12}$ gasoline is butane and pentane. With regard to the removal of the volatile components it is primarily the butane and pentane which is removed from the $C_4$–$C_{12}$ gasoline in the practice of this invention. If the gasoline contains hydrocarbons lighter than butane, it is desirable that they too be removed. The heavy, slow-burning component consists primarily of $C_{11}$ and $C_{12}$, each of which exists in numerous isomeric forms. These are removed and, if the starting stock gasoline contains hydrocarbons greater than $C_{12}$, it is desirable that they also be removed. In both cases the light volatile components and the heavy, slow-burning components are removed according to conventional known methods.

In the practice of a preferred embodiment of this invention, both components are removed, resulting in an intermediate hydrocarbon range. The boundaries of this range depend upon the extent to which the heavy and light components are removed. In this invention, both components are substantially removed but it is recognized that some may be left behind due to imperfections in current fractionation techniques. It is most desirable that the heavy and light components be substantially removed.

It is also recognized that the heavy and light components do not exist as absolutes but rather, as points on a continuum with the most volatile being the lighter hydrocarbons, and a gradual reduction in volatility and burning tendency as the weight is increased. This gives rise to certain "border line" components near both ends of the continuum. It is inevitable that some of these will be removed with the heavier and the lighter components. In general, it is recognized that the border line weights are $C_6$ and $C_{10}$. Thus, according to this invention, a substantial quantity of volatile component is removed to effectively reduce the potential for explosion and minimize the loss of gasoline due to evaporation. Likewise, the heavy component is also removed in an effective amount to raise the burn rate of the fuel and effect more complete combustion. Both of these components are removed and this fuel is used with an improvement in fuel combustion efficiency and engine performance.

This improvement is illustrated in FIG. 1. It will be noted that FIG. 1 shows a comparison which measures the efficiency of the fuel of the present invention versus the efficiency of conventional $C_4$–$C_{12}$ prior art fuels at various engine speeds. The fuel efficiency is measured in terms of Brake Specific Fuel Consumption (lbs. of fuel per horsepower hour). Lower Brake Specific Fuel Consumption values indicate better fuel efficiency.

The $C_6$–$C_{10}$ fuel of this invention may be used to run an engine equipped with the improved gasifier carburetor described herein. However, it is not necessary that volatile components be absent from the fuels used in the improved gasifier combustors since their presence in the fuel does not hinder the gasification process. Thus, some volatile $C_4$ and/or $C_5$ may be added to the $C_6$–$C_{10}$ fuel so that the fuel can be used in a standard carbureted engine as well as an engine equipped with the improved gasifier carburetor. For this reason the comparison presented in FIG. 1 utilized a $C_6$–$C_{10}$ fuel containing some $C_5$ volatile component so that the resulting $C_5$–$C_{10}$ fuel will run an engine equipped with an improved gasifier carburetor as well as a standard carbureted engine. The $C_5$–$C_{10}$ has a boiling point range about 49° F.–345° F.

In order to obtain the data shown in FIG. 1, identical engines were used to compare conventional $C_4$–$C_{12}$ unleaded gasoline (line A) with the $C_5$–$C_{10}$ fuel of this invention (line B). An identical engine was used to test the use of $C_5$–$C_{10}$ fuel in an improved carburetion system of the present invention (line C). It will be noted by comparing line A with line B that at all engine speeds, more pounds of fuel are required per horsepower hour for the $C_4$–$C_{12}$ gasoline than for the $C_5$–$C_{10}$ gasoline of the present invention. Therefore, the $C_5$–$C_{10}$ is significantly more efficient when combusted in identical engines. It will also be noted from FIG. 1 that an even greater efficiency is observed when the $C_5$–$C_{10}$ fuel is combusted in an identical engine equipped with the improved carburetion system of the present invention.

In a preferred embodiment of this invention, the $C_4$–$C_{12}$ gasoline is used as a starting ingredient from which the volatile $C_4$ and $C_5$ constituents and the heavy $C_{11}$ and $C_{12}$ components are removed. In the preferred embodiment the starting $C_4$–$C_{12}$ gasoline contains a mixture of each of the hydrocarbons (i.e., a mixture containing $C_4$, $C_5$, $C_6$, $C_7$, $C_8$, $C_9$, $C_{10}$, $C_{11}$ and $C_{12}$). Consequently, the intermediate $C_6$–$C_9$ and $C_6$–$C_{10}$ gasoline of the preferred embodiment will likewise contain the same intermediate hydrocarbons which are present in the starting gasoline. In other words, $C_6$–$C_9$ will contain, $C_6$, $C_7$, $C_8$, and $C_9$ and the $C_6$–$C_{10}$ gasoline will contain, $C_6$, $C_7$, $C_8$, $C_9$ and $C_{10}$ hydrocarbons.

In one embodiment of the present invention the light and heavy components are removed from conventional $C_4$–$C_{12}$ gasoline to produce a gasoline having a hydrocarbon range of $C_5$–$C_{10}$. Such a fuel is identical to the $C_6$–$C_{10}$ fuel with the exception of the presence of $C_5$ component in the $C_5$-$C_{10}$ fuel. Thus the $C_5$-$C_{10}$ fuel will have a boiling point range of about 49° F.-345° F.

Although the starting gasoline preferably contains the entire range of hydrocarbons from $C_4$-$C_{12}$ as described above, it is not absolutely essential that all of the intermediate hydrocarbons be present in the starting gasoline. However, it is critical that the $C_6$-$C_9$ fuel contains $C_9$ hydrocarbon and the $C_6$-$C_{10}$ gasoline contain $C_9$ and $C_{10}$ hydrocarbon.

The preferred intermediate range $C_6$-$C_{10}$ gasoline may be defined as the portion remaining when $C_4$-$C_{12}$ gasoline has removed therefrom an effective amount of lower weight volatile components to substantially reduce evaporative loss and explosion potential and effective amount of higher weight components to raise the burn rate of the remaining hydrocarbons. A $C_6$-$C_{10}$ gasoline which has these characteristics can be made by removing the volatile and heavy components so that the remaining hydrocarbon mixture will boil within a range of about 121° F.-345° F. at one atmosphere. Such a boiling point range encompasses the boiling point of the lowest boiling $C_6$ component and the highest boiling $C_{10}$ component. Of course, it is possible that a small amount of $C_4$, $C_5$, $C_{11}$ and $C_{12}$ may remain after the separation process due to imperfections of gasoline fractionation procedures.

Since the largest hydrocarbon in the preferred $C_6$-$C_{10}$ gasoline is $C_{10}$, then the final boiling point of such a mixture will be 345° F. It has been discovered that hydrocarbons having boiling points above 350° F. must be substantially eliminated so that the intermediate fuel can be gasified in a heated chamber in the absence of air, and then mixed with ambient air (i.e. about 70° F.) without condensing to form droplets of heavy hydrocarbons. This property is an essential aspect of the $C_6$-$C_{10}$ gasoline because the $C_6$-$C_{10}$ fuel is used in a modified carburetion system in which the fuel is gasified in a heated chamber and then mixed with air for immediate combustion in an automotive internal combustion engine. The absence of condensed droplets allows the gasoline to burn much more efficiently than conventional $C_4$-$C_{12}$ gasoline and, consequently, reduces pollution and improves engine performance. By removing $C_{11}$ and $C_{12}$ components from the starting stock gasoline, the final boiling point will be 345° F. and, thus, the gasoline will have the desired gasification property.

The gasification system used for intermediate hydrocarbon range gasoline requires heating the gasoline to lower temperatures that would be required for the gasification of $C_4$-$C_{12}$ gasoline. When lower temperatures are attained, the volumetric efficiency of the air and gas mixture going into an engine is improved.

The gasoline having hydrocarbons comprised essentially of $C_6$-$C_{10}$ hydrocarbons will have lower Reid Vapor Pressure than conventional $C_4$-$C_{12}$ gasoline with functional Reid Vapor Pressures less than two. Nonetheless, the $C_6$-$C_{10}$ gasoline will exhibit good ignition properties in the gaseous state when mixed with air. It will also provide excellent engine starting ability, will have reduced explosive potential and will burn more completely than $C_4$-$C_{12}$ gasoline. In addition, the $C_6$-$C_{10}$ gasoline will burn cooler in the engine with the modified carburetor and consequently the use of such a fuel will result in less lubrication requirements for the engine.

Conventional $C_4$-$C_{12}$ gasoline has high Reid Vapor Pressure and the Reid Vapor Pressure can be adjusted somewhat to provide summer or winter fuels. For example, the Reid Vapor Pressure can be increased by adding volatiles such as $C_4$ to enhance the winter performance of the conventional gasoline. However, the present $C_6$-$C_{10}$ invention requires lowering the Reid Vapor Pressure by removing the $C_4$ and $C_5$ components. Thus it would be expected that ability to formulate winter and summer fuels would be lost if the hydrocarbon range is limited to essentially $C_6$-$C_{10}$ hydrocarbons. It is therefore surprising that the $C_6$-$C_{10}$ gasoline can be formulated for winter use without additional $C_4$ priming. It has been discovered that a winter fuel can be made in the same manner as the $C_6$-$C_{10}$ summer gasoline with the exception being that the $C_{10}$ component is additionally separated from the starting $C_4$-$C_{12}$ gasoline along with the $C_4$, $C_5$, $C_{11}$ and $C_{12}$ components to provide a fuel that when gasified will remain substantially a gas when mixed with colder air. Thus, the present invention also provides a winter fuel having hydrocarbons which consists essentially of hydrocarbons in the range $C_6$-$C_9$. The $C_6$-$C_9$ winter gasoline differs from the $C_6$-$C_{10}$ gasoline only in the elimination of the $C_{10}$ component which is left in the $C_6$-$C_{10}$ summer gasoline. Consequently, the winter $C_6$-$C_9$ gasoline has a final boiling point of 303° F. and a boiling range of about 121° F.-303° F.

The $C_6$-$C_9$ gasoline must contain the $C_9$ hydrocarbon component and preferably should contain the remaining intermediate hydrocarbons which are $C_6$, $C_7$, and $C_8$ since these are preferably present in the $C_4$-$C_{12}$ gasoline. The $C_6$-$C_9$ winter gasoline is burned in an engine in the same manner described above with respect to the $C_6$-$C_{10}$ gasoline and enjoys the same benefits described above with respect to the $C_6$-$C_{10}$ gasoline.

The $C_6$-$C_{10}$ and $C_6$-$C_9$ gasoline is gasified by heating in a chamber in the absence of air to a temperature above the final boiling point of the gasoline. The $C_6$-$C_{10}$ and $C_6$-$C_9$ fuels are preferably heated to a temperature 350° F. Higher temperatures may be used but are not necessary. Conventional $C_4$-$C_{12}$ would require a temperature of about 75° higher to gasify and when mixed with air it would still have the problem of forming condensation droplets. Additionally, the higher temperature would lower the volumetric efficiency of the engine.

It has been emphasized that $C_9$ and $C_{10}$ must be present in the $C_6$-$C_{10}$ gasoline and $C_9$ must be present in the $C_6$-$C_9$ gasoline because heavy molecular components have the highest energy density. Since these are the highest density components capable of being gasified and remaining a gas when mixed with air, it is important that they remain in the gasoline for production of engine power.

It has also been discovered that the $C_6$-$C_{10}$ and the $C_6$-$C_9$ gasoline can be adapted for use in engines having standard carburetion (i.e., carburetors which do not require gasification in a heated chamber in the absence of air). In particular, it has been discovered that priming the $C_6$-$C_9$ and the $C_6$-$C_{10}$ gasoline with a small amount of a volatile component will result in the production of an improved gasoline which may be used in automobiles equipped with standard carburetion. The priming agent may be $C_4$, $C_5$, or a mixture of $C_4$ and $C_5$. Consequently the primed gasoline will have hydrocarbons which consists essentially of hydrocarbons in the range $C_4$-$C_{10}$ (summer) and $C_4$-$C_9$ (winter). The $C_4$-$C_9$ and $C_4$-$C_{10}$ gasoline is the same as the analogous $C_6$-$C_9$ and $C_6$-$C_{10}$ gasoline except for the presence of a small amount of priming agent in both the $C_4$–$C_9$ and $C_4$–$C_{10}$ gasoline.

In both the winter and summer fuel, the amount of priming agent is an amount effective to raise the front end volatility so that the fuel can be used in cars equipped with standard carburation. Thus the $C_4$–$C_9$ is particularly suitable for winter use and the $C_4$–$C_{10}$ is particularly suitable for summer use in cars equipped with standard carburetors. It is particularly significant and surprising that the amount of $C_4$ or $C_5$ in the $C_4$–$C_9$ and $C_4$–$C_{10}$ gasoline is less than the amount of $C_4$ or $C_5$ in conventional $C_4$–$C_{12}$ gasoline without sacrificing any of the desirable properties of the gasoline. It is also surprising that the $C_4$–$C_9$ and $C_4$–$C_{10}$ gasolines have adequate front end volatility yet are lower in Reid Vapor Pressure than conventional $C_4$–$C_{12}$ gasoline. It is believed that this is because removal of $C_{11}$ and $C_{12}$ from $C_4$–$C_{12}$ gasoline means that the remaining fuel will have a higher percentage of $C_4$, $C_5$, and $C_6$ hydrocarbons. therefore much of the $C_4$ and some of the $C_5$ hydrocarbons can be removed from the $C_4$–$C_{10}$ and $C_4$–$C_9$ gasoline to obtain a functionally equivalent front end volatility in comparison to the original $C_4$–$C_{12}$ gasoline. This reduces the Reid Vapor Pressure.

The gasoline of this invention may also contain any of the various additives presently in use or known to be useful in gasoline. In fact, because this invention produces a gasoline having a low Reid Vapor Pressure, as compared to normal automotive gasoline, it is possible to add large amounts of alcohol such as ethanol to the gasoline of this invention without raising the Reid Vapor Pressure above the current allowable limits. Alcohol addition to conventional gasoline is known to raise the Reid Vapor Pressure above the allowable limits. Additions of alcohol can be added to the fuels of this invention in an amount of 10–20 per cent by weight without exceeding current Reid Vapor Pressure standards.

It is also possible to add lubricants or anti-knock compounds to the gasoline. For example, a suspension of fine synthetic upper end lubricants or small amounts of anti-knock compounds may be added the gasoline of this invention.

It has also been surprisingly discovered that the fuels of this invention when gasified burn almost completely in the engine producing equivalent torques with less fuel and at temperatures which are lower than the temperatures achieved when combusting conventional fuels in engines equipped with standard carburetion systems. This is true at stoichiometric or slightly higher air-to-fuel ratios which would normally result in the development of excessive engine temperature. Therefore, combusting the gasoline of this invention produces less nitrous oxide and allows some increase in compression or supercharging without damage to the engine and without environmental contamination.

The gasoline of this invention is an intermediate hydrocarbon fuel and naturally exists in the liquid state at standard temperature and pressure. Thus the gasoline can be shipped, stored and dispensed like conventional gasoline and requires no further processing for use.

It has also been discovered that the fuels of this invention burn cooler than conventional $C_4$–$C_{12}$ fuel. For this reason may be advantageous to add an oxygen source to the fuel to obtain more complete combustion. The oxygen source raises the combustion temperature. However, due to the fact that the fuels of the present invention burn cooler than convetional $C_4$–$C_{12}$ gasoline, the elevated combustion temperature can be tolerated in automobile engines. Thus, an oxygenate compound may be added to the fuels of the present invention to raise combustion temperatures or to effect more complete combustion. Many suitable oxygen source may be used. Typical oxygen sources include oxygenated hydrocarbons such as 1, 2 butylene oxide.

EXAMPLE 1

$C_5$–$C_{10}$ fuel was made by removing the hydrocarbons lighter than $C_5$ and the hydrocarbons heavier than $C_{10}$ from a conventional $C_4$–$C_{12}$ gasoline. The $C_4$–$C_{12}$ gasoline which served as the starting ingredient contains $C_5$, $C_6$, $C_7$, $C_8$, $C_9$, and $C_{10}$ hydrocarbons in addition to the heavy and light hydrocarbons which were removed therefrom. The resulting $C_5$–$C_{10}$ fuel therefore contains $C_5$, $C_6$, $C_7$, $C_8$, $C_9$, $C_{10}$ hydrocarbons. The $C_5$–$C_{10}$ fuel had a Reid Vapor Pressure of 6. The fuel was used to start and run a standard carbureted Volkswagon engine. Measurements of fuel efficiency were taken and the rusults are shown in Table I, (line B). During the test it was noted that the standard carbureted engines started and ran easily even though the fuel had a Reid Vapor Pressure of only 6.

EXAMPLE 2

For the purpose of comparison, the $C_4$–$C_{12}$ fuel described in example 1 was used to start and run a Volkswagon engine which was identical to the engine used for testing the $C_5$–$C_{10}$ fuel in example 1. The $C_4$–$C_{12}$ fuel had a Reid Vapor Pressure of 10. The efficiency of the $C_4$–$C_{12}$ fuel was measured and the results are shown in FIG. 1 (line A).

EXAMPLE 3

The C5–$C_{10}$ fuel used in example 1 was also tested in an engine identical to the engine used in example 1 with the exception that the engine used in example 3 was equipped with an improved carburetion system of the present invention. The fuel efficiency was measured and the results are shown in Table I (line C). During the test it was noted that the $C_5$–$C_{10}$ fuel easily started and ran the engine equipped with the improved carburetor even though the fuel had a Reid Vapor Pressure of only 6.

While the present invention has been described in terms of certain preferred embodiments and exemplified with respect thereto, one skilled in the art will readily appreciate that variations, modifications, changes, omissions and substitutions may be made without departing from the spirit thereof. It is intended, therefore, that the present invention be limited solely by the scope of the following claims.

I claim:

1. A method of operating an internal combustion engine which comprises vaporizing a gasoline-alcohol fuel mixture by heating it in a chamber to above the final boiling point of the gasoline at one atmosphere pressure in the absence of air to form a vaporized gasoline-alcohol fuel mixture and immediately mixing the vaporized gasoline-alcohol fuel mixture with air in a carburetor without forming liquid droplets in the mixture and then immediately combusting the mixture in the engine in substantially a vaporized state; said gasoline comprising a mixture of hydrocarbons; said mixture having an intermediate carbon range relative to $C_4$–$C_{12}$ fuel; said intermediate carbon range consisting essentially of the hydrocarbons in the range of $C_6$–$C_{10}$ with $C_9$ and $C_{10}$ hydrocarbons being present in the gasoline;

said gasoline having a boiling point range between 121° F. and about 345° F. at 1 atmosphere pressure and said gasoline being capable of being vaporized by heating in a chamber to a temperature above the final boiling point of the gasoline at one atmosphere pressure and said vapor capable of being immediately mixed with air in a carburetor without the substantial instantaneous formation of liquid droplets therein so that said vapor/air mixture can be immediately combusted in the engine in a completely vaporized form.

2. The method of claim 1 wherein the gasoline further comprises $C_6$, $C_7$ and $C_8$ hydrocarbons.

3. A method of operating an internal combustion engine which comprises vaporizing a gasoline-alcohol fuel mixture by heating it in a chamber to a temperature above the final boiling point of the gasoline at one atmosphere pressure in the absence of air to form a vaporized gasoline-alcohol fuel mixture and immediately mixing the vaporized gasoline-alcohol fuel mixture with air in a carburetor without forming liquid droplets in the mixture and then immediately combusting the mixture in the engine in a completely vaporized state; said gasoline comprising a mixture of hydrocarbons said mixture having an intermediate carbon range relative to $C_4$–$C_{12}$ fuel; said intermediate carbon range consisting essentially of the hydrocarbons in the range of $C_6$–$C_9$ with a $C_9$ hydrocarbon component being present in the gasoline; and said gasoline having a boiling point range between 121° F. and about 303° F. at 1 atmosphere pressure and said gasoline being capable of being vaporized by heating in a chamber to a temperature above the final boiling point of the gasoline at one atmosphere pressure in the absence of air and said vapor being capable of being immediately mixed with air in a carburetor without the substantial instantaneous formation of liquid droplets therein so that said vapor/air mixture can be immediately combusted in the engine in substantially vaporized form.

4. The method of claim 3 wherein the hydrocarbon mixture includes $C_6$, $C_7$ and $C_8$ hydrocarbons.

5. The process of operating an internal combustion engine comprising introducing gasoline fuel into a heated chamber, in the absence of air, to instantly volatize said fuel to a vapor, mixing said heated vapor with air to form a homogeneous mixture and then introducing said mixture into the combustion chamber of said engine; said gasoline fuel comprising hydrocarbons having an intermediate carbon range relative to gasoline which has a carbon range of $C_4$–$C_{12}$; said intermediate range being defined as the portion remaining when $C_4$–$C_{12}$ gasoline has removed therefrom an effective amount of lower weight volatile components to substantially eliminate evaporative loss and explosion potential and an effective amount of higher weight components to raise the burn rate of the remaining hydrocarbons to a level comparable to $C_4$–$C_{12}$ gasoline and said intermediate carbon range consisting essentially of hydrocarbons in the range of from $C_5$–$C_{10}$.

6. The process of claim 5 wherein the chamber is heated to 425° F.±25° F.

7. The process of claim 5 wherein the intermediate carbon range consists of hydrocarbons in the range of $C_5$–$C_{10}$.

8. The process of claim 6 wherein the intermediate carbon range consists of hydrocarbons in the range of $C_5$–$C_{10}$.

9. The method of claim 5 wherein the gasoline fuel is vaporized by heating it in a chamber to above the final boiling point of the gasoline at 1 atmosphere pressure to form the heated vapor; the heated vapor is immediately mixed with the air in a carburetor without forming liquid droplets in the mixture and the mixture is immediately combusted in a combustion chamber of the engine in substantially a vaporized state; and said gasoline fuel is a mixture of hydrocarbons in the range of $C_6$–$C_{10}$ with $C_9$ and $C_{10}$ hydrocarbons being present in the gasoline; said gasoline having a boiling point range between 121° F. and about 345° F. at 1 atmosphere pressure and said gasoline being capable of being vaporized by heating in a chamber to a temperature above the final boiling point of the gasoline at one atmosphere pressure and said vapor capable of being immediately mixed with air in a carburetor without the substantial instantaneous formation of liquid droplets therein so that said vapor/air mixture can be immediately combusted in the engine in a completely vaporized form.

10. The method of claim 9 wherein the gasoline further comprises $C_6$, $C_7$ and $C_8$ hydrocarbons.

11. The method of claim 5 wherein the gasoline is vaporized by heating it in a chamber to a temperature above the final boiling point of the gasoline at 1 atmosphere pressure in the absence of air to form a heated vapor; said heated vapor is mixed with the air in a carburetor without forming liquid droplets in the mixture; and said mixture is immediately combusted in the combustion chamber of the engine in a completely vaporized state; and said intermediate carbon range consists essentially of hydrocarbons in the range of $C_6$–$C_9$ with a $C_9$ hydrocarbon component being present in the gasoline; and said gasoline having a boiling point range between 121° F. and about 303° F. at 1 atmosphere pressure and said gasoline being capable of being vaporized by heating in a chamber to a temperature above the final boiling point of the gasoline at 1 atmosphere pressure in the absence of air and said vapor being capable of being immediately mixed with air in a carburetor without the substantial instantaneous formation of liquid droplets therein so that said vapor/air mixture can be immediately combusted in the engine in substantially vaporized form.

12. The method of claim 11 wherein the hydrocarbon mixture includes $C_6$, $C_7$ and $C_8$ hydrocarbons.

* * * * *